US005180875A

United States Patent [19]

Berry, Jr. et al.

[11] Patent Number: 5,180,875

[45] Date of Patent: Jan. 19, 1993

[54] SCOPE ADJUSTMENT FOR FIREARMS

[76] Inventors: Waldo A. Berry, Jr., R.D. 1, Box 259, Carmichaels, Pa. 15320; Edward M. Klara, P.O. Box 323, Grant Town, W. Va. 26574

[21] Appl. No.: 540,904

[22] Filed: Jun. 20, 1990

[51] Int. Cl.[5] ..... F41G 1/38

[52] U.S. Cl. ..... 42/101; 33/245; 359/422; 359/432

[58] Field of Search ..... 42/101, 100; 350/559, 350/560; 33/245, 246, 248

[56] References Cited

U.S. PATENT DOCUMENTS

| | | | |
|---|---|---|---|
| 2,550,694 | 5/1951 | Hazen | 33/53 |
| 2,583,042 | 1/1952 | Dayton | 33/50 |
| 3,506,330 | 4/1970 | Allen | 350/560 |
| 3,545,356 | 12/1970 | Nielsen | 95/12 |
| 3,612,646 | 10/1971 | Walker | 350/54 |
| 4,084,326 | 4/1978 | Numbers | 33/245 |
| 4,142,139 | 2/1979 | Slaats et al. | 318/603 |
| 4,317,304 | 3/1982 | Bass | 42/101 |
| 4,395,096 | 7/1983 | Gibson | 33/245 |
| 4,952,041 | 8/1990 | Sandall | 350/560 |

FOREIGN PATENT DOCUMENTS

| | | | |
|---|---|---|---|
| 113223 | 2/1945 | Sweden | 33/246 |

*Primary Examiner*—Stephen M. Johnson

*Attorney, Agent, or Firm*—Webb, Burden, Ziesenheim & Webb

[57] ABSTRACT

Adjustment means for a scope having a tubular body and a zoom ring mounted on the tubular body for varying the magnification power of the scope are disclosed. A first gear is concentrically mounted on the zoom ring for rotation therewith, and a second gear is carried on the tubular body and is engageable with the first gear. The second gear has a concentric shaft, and manual, electro-mechanical or dual means for rotating the shaft are provided. When the scope is used with a rifle, the means for rotation may be adjusted by a shooter without removing one hand from the firing position.

28 Claims, 3 Drawing Sheets

SCOPE ADJUSTMENT FOR FIREARMS

BACKGROUND OF THE INVENTION

1. Field of the Invention

This invention relates to telescopic lenses and, more particularly, to those which may be adjusted to provide variable magnification power. This invention is especially applicable to firearms.

2. Description of the Prior Art

Telescopic lenses having variable magnification powers have been found useful in many applications such as in microscopes, cameras and rifles. Such scopes are commonly said to be equipped with a "zoom lens", denoting the ability of the scope to seemingly zoom in on the object of the viewer when the magnification power of the scope is increased. The zoom lens on the scope is commonly adjusted by manual rotation of a vernier located on the body of the scope. Such adjustments have been found awkward in many cases, particularly regarding rifles, where the shooter must remove one hand from the firing position while at the same time struggling to keep his mark on the target.

Hazen, et al. U.S. Pat. No. 2,550,694 discloses an early attempt to provide remote adjustment means for a gun sight. The adjustment means is linked to the action of the trigger to provide a zooming effect through the gun sight. The gun sight is not optical, but rather, it is purely mechanical in operation.

Bass U.S. Pat. No. 4,317,304 discloses a remote adjustment means for varying the range and elevation of a rifle scope. A handle is positioned near the hand grip area of the rifle, and when the shooter squeezes the handle a rotatable gear is caused to move up a geared ramp, thus raising the front end of the scope.

Finally, Nielsen U.S. Pat. No. 3,545,356 discloses a camera-telescope for a gun, the camera being arranged to photograph the image of the telescope. Control means are provided adjacent to the hand grip of the gun, and the control means may be operated independently of the gun.

The prior art discussed does not address the problem of providing remote adjustment means for zoom lenses, particularly, those which are in use with firearms. It has been found desirable to provide firearms, especially high-powered rifles which have variable power telescopic sights, with remote adjustment means for increasing or decreasing the magnification power of the scope. Additionally, it is preferred that the adjustment means be positioned on the firearm in a way which allows the shooter to keep his mark on the target while adjusting the scope.

SUMMARY OF THE INVENTION

The present invention comprises a scope adjustment means for firearms which may be utilized by a shooter without the necessity of the shooter removing one hand from the firing position. The scope comprises a tubular body having an eyepiece end and a rangefinder end, at least one lens within the tubular body and a zoom ring mounted on the tubular body for varying the magnification power of the lens. Adjustment means for manipulating the zoom ring are disclosed, and the adjustment means include a first gear which is concentrically mounted on the zoom ring for rotation therewith, and a second gear which is carried on the tubular body and is engageable with the first gear.

The second gear has a concentric shaft, and means for rotating the shaft and the second gear on a first axis are included. Rotation of the shaft on the first axis will cause rotation of the first gear and the zoom ring on a second axis, thus varying the magnification power of the lens.

The means for rotating the shaft may include a thumb wheel mounted on an end of the shaft opposite the second gear. Alternatively, the means may include an electric motor which is mounted on the tubular body of the scope and which is controlled by a rocker switch. The first gear and the second gear may both comprise either bevel gears or ring gears.

Other features and advantages of the present invention will become apparent from the following detailed description in conjunction with the accompanying drawings.

DETAILED DESCRIPTION OF THE EMBODIMENTS

Figure 1:
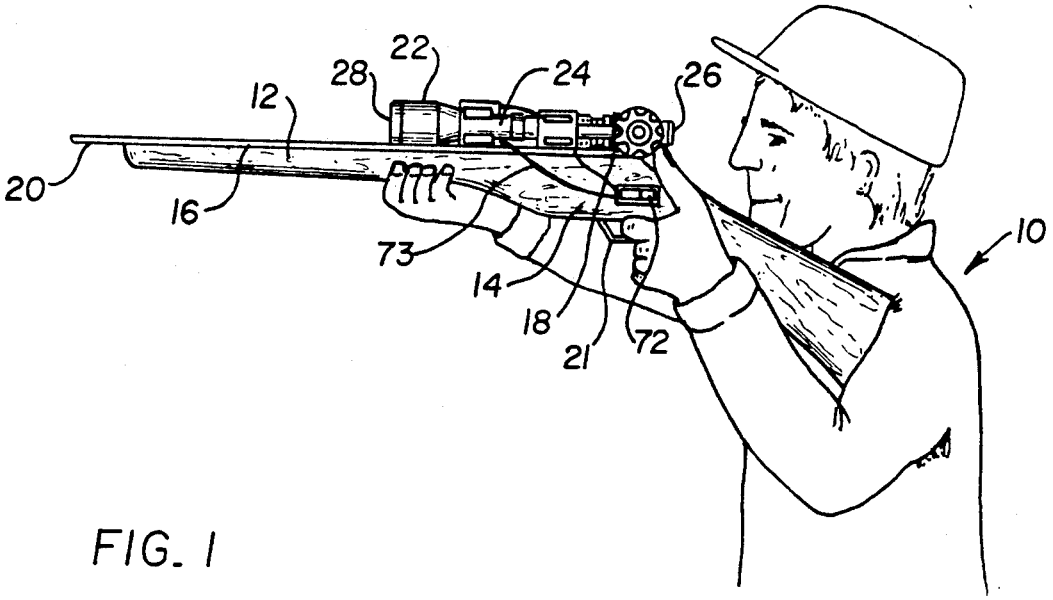
FIG. 1 is a perspective of a shooter holding a rifle in the firing position, and the rifle has a scope with a thumb wheel mounted vertically on the left side of the scope according to the present invention.

FIG. 1 shows a shooter 10 holding a rifle 12 with both hands in the firing position. The rifle includes a stock 14 having a barrel 16 extending therefrom. The barrel 16 has a breech end 18 located on the stock 14 and a muzzle end 20 spaced from the stock 14. A trigger 21 is located on the stock 14 near the breech end 18 of the barrel 16. A scope 22 is mounted on the barrel 16 intermediate the breech end 18 and the muzzle end 20 to enhance the shooter's view of his target. The scope 22 may be mounted on the barrel 16 by various methods well known to those skilled in the art.

The scope 22 has a tubular body 24 with an eyepiece end 26 and a rangefinder end 28. There is at least one telescopic lens (not shown) within the tubular body 24 for magnifying the shooter's view of the target. For purposes of the present invention, the only requirement for the number and configuration of lenses within the scope 22 is that they operate to give the scope 22 a variable power capability, i.e., they provide the viewer with a range of magnification powers in which to view his target. For example, the scope 22 may provide a range of magnification powers of 3×-9×, 4×-12×, and so on. The present invention provides an adjustment means for varying the magnification power of the scope with the advantage of allowing the shooter 10 to keep both hands in the firing position.

Figure 2:
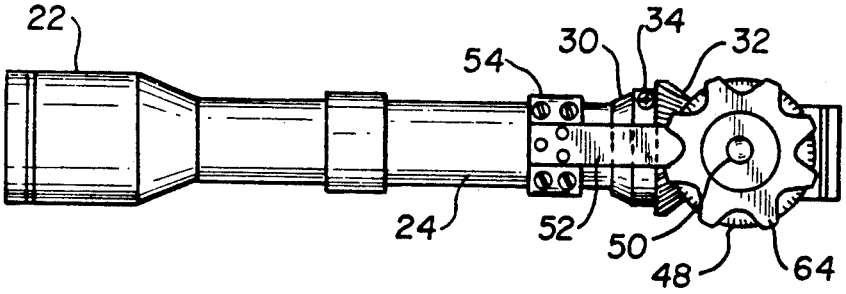
FIG. 2 is a side elevational view of a first embodiment of the invention.
Figure 3:
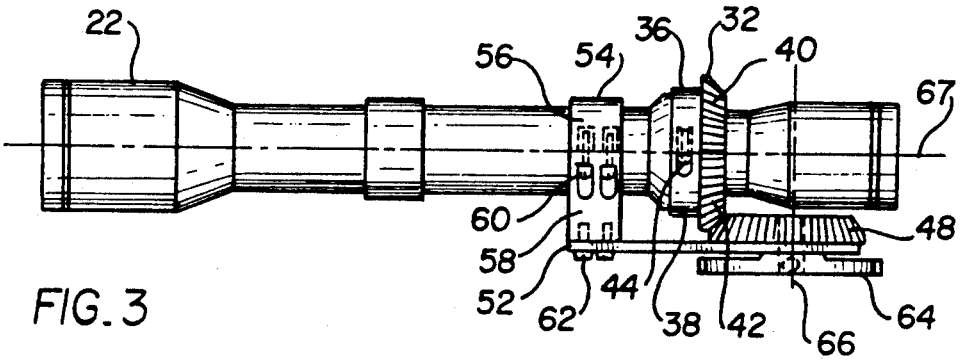
FIG. 3 is a top view of FIG. 2.
Figure 4:
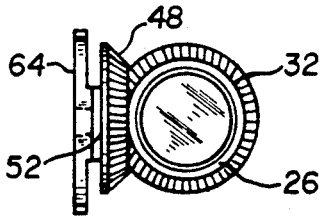
FIG. 4 is a section taken along lines IV—IV of FIG. 2.

A first embodiment of the adjustment means is manually operated and is shown in FIGS. 2-4. The scope 22 has a zoom ring 30 mounted on the tubular body 24. Rotation of the zoom ring 30 clockwise or counterclockwise will increase or decrease the magnification power of the scope 22 accordingly. A first gear 32 is concentrically mounted on the zoom ring 30 so that rotation of the first gear 32 will likewise cause rotation of the zoom ring 30. The first gear 32 may be manufactured integrally with the zoom ring 30 or it may be adapted to fit various sized zoom rings on conventional variable power scopes.

Figure 5:
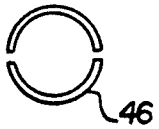
FIG. 5 is a side elevational view of a pair of bushings.
Figure 6:
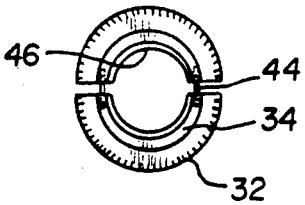
FIG. 6 is a side elevational view of the bushings of FIG. 5 inserted in a zoom ring clamp.

Specifically, the first gear may be carried on a zoom ring clamp 34 which is concentric with the zoom ring 30 and which is mounted on the zoom ring 30 for simultaneous rotation therewith. The zoom ring clamp 34 and the first gear 32 may each comprise a first portion 36, 40 and a second portion 38, 42, which are mated to encircle the zoom ring 30. The first portion 36 and the second portion 38 may be manufactured integrally, as may be the first portion 40 and the second portion 42. The first portion 36, 40 and the second portion 38, 42 may be joined by a plurality of screws 44 or by comparable fasteners when mounted on the zoom ring 30. Referring to FIGS. 5-6, a plurality of bushings 46 may be inserted between the zoom ring 30 and the zoom ring clamp 34 to fill gaps caused by any difference between the outer diameter of the zoom ring 30 and the inner diameter of the zoom ring clamp 34 and the first gear 32. This provides for universal fitting of the invention on conventional scopes of varying dimensions.

Figure 8:
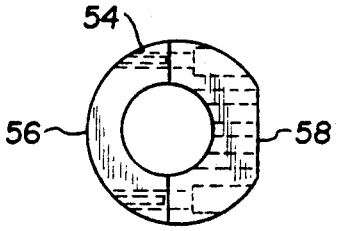
FIG. 8 is a side elevational view of a mounting clamp.
Figure 9:
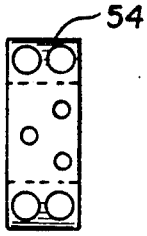
FIG. 9 is a rear view of the mounting clamp of FIG. 8.
Figure 7:
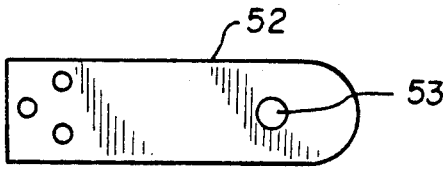
FIG. 7 is a side elevational view of a brace.

A second gear 48 is engageable with the first gear 32 and is carried by the tubular body 24. The second gear also has a concentric shaft 50 to provide for rotation of the second gear 48 as discussed in further detail below. The second gear 48 may be carried by the tubular body 24 with a brace 52, shown in FIG. 7. The brace 52 depends from a mounting clamp 54, shown in FIGS. 8-9, which encircles the tubular body 24 in a manner identical to that discussed above in connection with the zoom ring clamp 34. Note, however, that the mounting clamp 54 is slightly eccentric to provide clearance for the bolt when the invention is fitted on bolt action rifles.

Specifically, the mounting clamp 54 may also have a first portion 56 and a second portion 58 which may be joined by a plurality of screws 60 to nonrotatively engage the tubular body 24. Likewise, a plurality of bushings 46 may be provided to ensure universal fitting of the mounting clamp with conventional variable power scopes. Alternatively, the brace 52, the mounting clamp 54, or both, may be integral with the tubular body 24. The brace 52 is secured at one end to the mounting clamp 54 by a plurality of screws 62, or the like, and at an opposite end, the brace carries the concentric shaft 50 of the second gear 48 via a bore 53.

Figure 10:
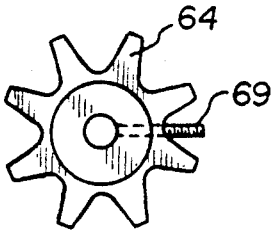
FIG. 10 is a side elevational view of a thumb wheel.

Means, such as a thumb wheel 64 shown in FIG. 10, are provided on an end of the shaft 50 opposite the second gear 48 for manual rotation by the shooter 10 of the second gear 48 on a first axis 66, thereby rotating the first gear 32 and the zoom ring 30 on a second axis 67 and varying the magnification power of the scope 22. The thumb wheel 64 may be secured to the shaft 50 by an allen screw 69 or the like. In order to permit rotation of the zoom ring 30, the first gear 32 and the second gear 48 are of complementary bevel gear construction. As shown in FIG. 1, the thumb wheel 64 is vertically disposed adjacent to the trigger 21 on the stock 14 on the left side of the scope 22, thereby allowing the shooter 10 to keep both hands in the firing position while adjusting the power of the scope 22.

The thumb wheel 64 may be positioned with respect to the scope 22 to accommodate any type of firearm or to suit shooter preference. The thumb wheel 64 may be positioned vertically on either side of the scope, 22, or horizontally on either the top or bottom side of the scope 22. This allows the thumb wheel 64 to be used by right handed or left handed shooters and with various types of firearms, including bolt-action, left-handed, right-handed, semi-automatic or pump action rifles.

Figure 11:
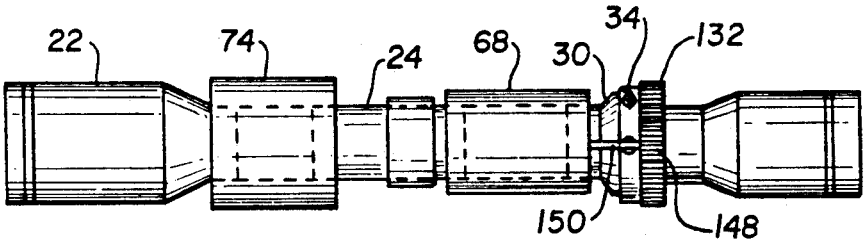
FIG. 11 is a side elevational view of the second embodiment of the invention.
Figure 12:
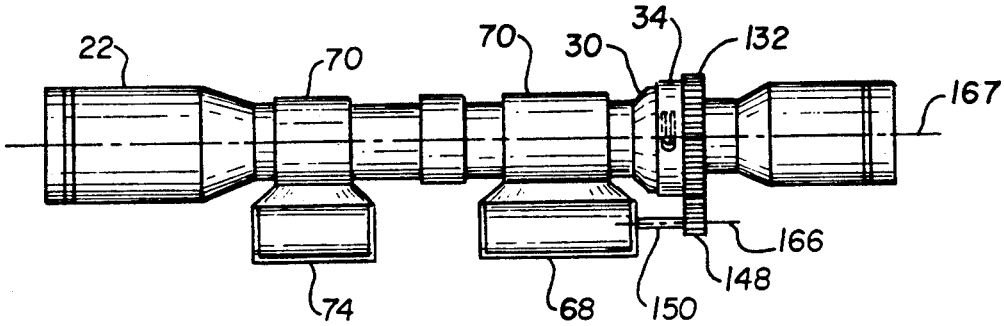
FIG. 12 is a top view of the second embodiment of FIG. 11.
Figure 13:
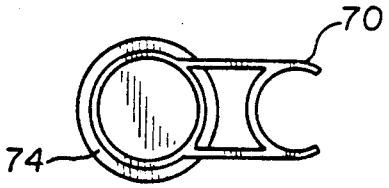
FIG. 13 is a front elevational view of a battery pack.

A second embodiment of the invention, shown in FIGS. 11-12, utilizes electro-mechanical means to provide remote adjustment of the zoom ring 30. A first gear 132 is mounted on the zoom ring 30 either integral with the zoom ring or by the zoom ring clamp 34, as discussed above in connection with the first embodiment. A second gear 148 having a concentric shaft 150 is engageable with the first gear 132. The concentric shaft 150 is driven by a conventional electric motor 68 which is mounted on the tubular body 24. Again, the electric motor may be manufactured integrally with the tubular body 24 or it may include a flexible u-clip 70, as shown in FIG. 13, which allows the electric motor 68 to be removeably mounted on various sized conventional scopes.

A rocker switch 72 is electrically circuited with the electric motor 68 by a wire 73, and the rocker switch 72 is mounted on the stock 14 adjacent the trigger 21. The rocker switch 72 allows the shooter 10 to operate the electric motor 68 in a forward mode, an off mode or a reverse mode by virtue of its three-position capability. The first gear 132 and the second gear 148 are of complementary ring gear construction. When the electric motor 68 is engaged by the appropriate positioning of the rocker switch 72, the electric motor will drive the concentric shaft 150 and rotate the second gear 148 on a first axis 166, thereby rotating the first gear 132 in the opposite direction on a second axis 167. Thus, the shooter 10 may adjust the magnification power of the scope 22 simply by manipulating the rocker switch 72, without removing either hand from the rifle firing position.

Figure 14:
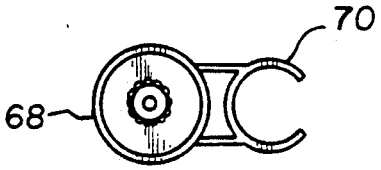
FIG. 14 is a front elevational view of an electric motor.

A battery pack 74 such as utilized in conventional flashlights may be mounted on the tubular body 24 in the same manner as the electric motor 68. The battery pack 74 is electrically circuited with the electric motor and the rocker switch 72 for supplying power thereto via wire 73. The electric motor 68 and the battery pack 74 are shown separately in FIGS. 13-14.

Figure 16:
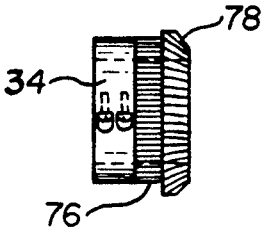
FIG. 16 is a side elevational view of a combination ring gear and bevel gear.
Figure 15:
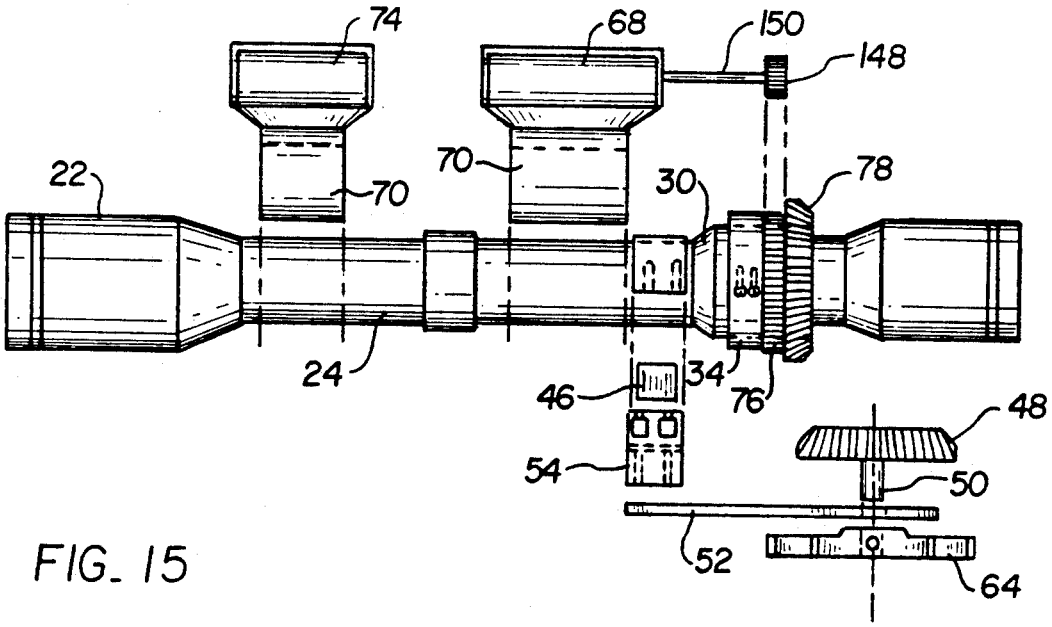
FIG. 15 is a top exploded view of a third embodiment of the invention.

A third embodiment of the invention utilizes both electro-mechanical means, as in the second embodiment, and manual means, as in the first embodiment, to provide a dual capability for adjusting the scope 22. Referring to FIG. 15, to facilitate dual adjustment the first gear 32, 132 is provided with a front gear portion 76 and a rear gear portion 78 as shown in FIG. 16, each engageable with gear 148 and gear 48, respectively. Both the front gear portion 76 and the second gear 148 are of the ring gear type, while the rear gear portion 78 and second gear 48 are of the bevel gear type, as discussed in connection with the first embodiment. The remaining elements of the third embodiment are as discussed in connection with their counterparts in both the first embodiment and the second embodiment.

Thus, the present invention provides a scope adjustment for rifles, especially high-powered rifles, which may be manipulated by the shooter without a need for the shooter to remove either hand from the rifle firing position. This allows the shooter to keep his mark on the target while increasing the magnification power of the scope to provide a clearer image of the target, a narrower field and more accurate aim. The third embodiment of the invention, utilizing both electro-mechanical and manual override scope adjustments, provides the shooter with the capability to adjust the scope in two different manners. The electro-mechanical adjustment may be advantageous for targets which are at a greater distance from the shooter, as the only motion required of the shooter is simply the press of a button located adjacent the trigger. This allows the shooter to keep a steady aim on the target, which is more easily lost from the rangefinder of the scope at greater distances.

The manual override adjustment may be more advantageous for targets, such as game, which are at shorter distances from the shooter and which may be easily spooked by the sound of the electric motor. The manual adjustment, involving a simple rotation of means like the thumb wheel, is relatively silent.

While the invention has been described in connection with telescopic or 300m lenses for high-powered rifles, it will be understood by those skilled in the art that the invention may equally be practiced with microscopes, sight-seeing telescopes, and generally any scope which has a zoom lens that is adjusted by a zoom ring.

Having described the presently preferred embodiments of the invention, it will be understood that it may be otherwise embodied within the scope of the appended claims.

We claim:

1. A variable magnification power scope comprising:

a tubular body having an eyepiece end and a rangefinder end;

at least one lens within the tubular body;

a zoom ring mounted on the tubular body for varying the magnification power of the scope; and adjustment means for manipulating the zoom ring, said adjustment means comprising:

a first gear concentrically mounted on the zoom ring for rotation therewith, a zoom ring clamp concentrically mounted on the zoom ring and carrying said first gear, each of said zoom ring clamp and said first gear including a first portion and a second portion which are adapted for attachment to one another to encircle the zoom ring, a second gear carried on the tubular body and engageable with the first gear, a concentric shaft depending from the second gear, and means for rotating the shaft and the second gear on a first axis, thereby rotating the first gear and the zoom ring on a second axis and varying the magnification power of the scope.

2. The scope of claim 1 further including a brace depending from the tubular body for carrying the shaft.

3. The scope of claim 2 further including a mounting clamp which is concentrically engaged on the tubular body and which carries said brace.

4. The scope of claim 3 wherein said mounting clamp includes a first portion and a second portion which are adapted for attachment to one another to encircle the tubular body.

5. The scope of claim 4 further including at least one bushing for insertion between the mounting clamp and the tubular body.

6. The scope of claim 1 wherein said means for rotating the shaft comprises an electric motor mounted on the tubular body.

7. The scope of claim 6 further including a battery pack mounted on the tubular body for supplying power to the electric motor.

8. The scope of claim 7 wherein said battery pack is removeably mounted to the tubular body by a u-clip.

9. The scope of claim 6 wherein said electric motor is removeably mounted to the tubular body by a u-clip.

10. The scope of claim 6 further including a rocker switch electrically connected to the electric motor for operating the electric motor in a forward mode, an off mode and a reverse mode.

11. The scope of claim 1 wherein said first gear and said second gear both comprise ring gears.

12. The scope of claim 1 wherein said first gear further includes a front gear portion and a rear gear portion.

13. The scope of claim 12 further including a third gear having a second concentric shaft, said third gear engageable with the front gear portion of the first gear.

14. The scope of claim 13 further including an electric motor mounted on the tubular body for driving the second concentric shaft and rotating the third gear on a third axis, thereby rotating the first gear and the zoom ring on said second axis and varying the magnification power of the lens scope.

15. The scope of claim 1 wherein said first gear and said second gear both comprise bevel gears.

16. A variable magnification power scope comprising:

a tubular body having an eyepiece end and a rangefinder end;

at least one lens within the tubular body;

a zoom ring mounted on the tubular body for varying the magnification power of the scope; and adjustment means for manipulating the zoom ring, said adjustment means comprising:

a first gear concentrically mounted on the zoom ring for rotation therewith, a second gear carried on the tubular body and engageable with the first gear, a concentric shaft depending from the second gear, and means for rotating the shaft and the second gear on a first axis, thereby rotating the first gear and the zoom ring on a second axis and varying the magnification power of the scope;

wherein said means for rotating the shaft comprises a thumb wheel mounted on an end of the shaft opposite the second gear.

17. The scope of claim 16 further including a zoom ring clamp which is concentrically mounted on the zoom ring and which carries said first gear.

18. The scope of claim 16 wherein both said zoom ring clamp and said first gear comprise a first portion and a second portion which are adapted for attachment to one another to encircle the zoom ring for simultaneous rotation therewith.

19. The scope of claim 18 further including at least one bushing for insertion between the zoom ring clamp and the zoom ring.

20. A variable magnification power scope comprising:

a tubular body having an eyepiece end and a rangefinder end;

at least one lens within the tubular body;

a zoom ring mounted on the tubular body for varying the magnification power of the scope; and adjustment means for manipulating the zoom ring, said adjustment means comprising:

a first gear concentrically mounted on the zoom ring for rotation therewith, said first gear further including a front gear portion and a rear gear portion, a second gear carried on the tubular body and engageable with the first gear, a concentric shaft depending from the second gear, and means for rotating the shaft and the second gear on a first axis, thereby rotating the first gear and the zoom ring on a second axis and varying the magnification power of the scope;

wherein said front gear portion is a ring gear and said rear gear portion is a bevel gear.

21. A rifle adapted to be held with both hands by a shooter comprising:

a stock;

a barrel extending from the stock, said barrel having a breech end located on the stock and a muzzle end spaced from the stock;

a trigger fixed to the stock near the breech end of the barrel;

a scope mounted on the barrel intermediate the breech end and the muzzle end, said scope having a tubular body with an eyepiece end and a rangefinder end, with at least one lens mounted within the tubular body and a zoom ring mounted on the tubular body for varying the magnification power of the scope;

a zoom ring clamp engaged on the zoom ring;

a first gear carried by said zoom ring clamp and concentrically mounted on the zoom ring for simultaneous rotation therewith;

a second gear carried on the tubular body and engageable with the first gear, said second gear having a concentric shaft; and adjustment means mounted on the rifle for rotating the shaft and the second gear on a first axis thereby rotating the first gear and the zoom ring on a second axis, said adjustment means disposed adjacent the trigger so that the shooter can vary the magnification power of the scope without removing one hand from the rifle;

wherein said adjustment means comprises a thumb wheel mounted on an end of the shaft opposite the second gear and disposed adjacent the trigger for rotating the shaft.

22. The rifle of claim 21 further including a brace which depends from the tubular body for carrying the first concentric shaft.

23. The rifle of claim 21 wherein said adjustment means comprises an electric motor mounted on the tubular body for rotating the shaft.

24. The rifle of claim 23 further including a rocker switch which is electrically connected to the electric motor and which is mounted on the stock adjacent the trigger for operating the electric motor in a forward mode, an off mode and a reverse mode.

25. The rifle of claim 21 wherein said first gear has a front gear portion and a rear gear portion.

26. A rifle adapted to be held with both hands by a shooter comprising:

a stock a barrel extending from the stock, said barrel having a breech end located on the stock and a muzzle end spaced from the stock;

a trigger fixed to the stock near the breech end of the barrel;

a scope mounted on the barrel intermediate the breech end and the muzzle end, said scope having a tubular body with an eyepiece end and a rangefinder end, with at least one lens mounted within the tubular body and a zoom ring mounted on the tubular body for varying the magnification power of the scope;

a zoom ring clamp engaged on the zoom ring;

a first gear carried by said zoom ring clamp and concentrically mounted on the zoom ring for simultaneous rotation therewith;

a second gear carried on the tubular body and engageable with the first gear, said second gear having a concentric shaft; and adjustment means mounted on the rifle for rotating the shaft and the second gear on a first axis thereby rotating the first gear and the zoom ring on a second axis, said adjustment means disposed adjacent the trigger so that the shooter can vary the magnification power of the scope without removing one hand from the rifle;

wherein said first gear has a front gear portion and a rear gear portion, said rifle further including a third gear engageable with the front gear portion of the first gear, said third gear having a second concentric shaft, said second gear engageable with the rear gear portion of the first gear.

27. The rifle of claim 26 wherein said adjustment means comprises a thumb wheel which is mounted on an end of the shaft opposite the second gear and which is disposed adjacent the trigger for rotating the shaft.

28. The rifle of claim 26 wherein said adjustment means comprises an electric motor mounted on the tubular body for rotating the second concentric shaft and a thumb wheel mounted on an end of the first concentric shaft opposite the second gear for rotating the first concentric shaft.

* * * * *